US007883772B2

(12) United States Patent
Pourdeyhimi et al.

(10) Patent No.: US 7,883,772 B2
(45) Date of Patent: Feb. 8, 2011

(54) HIGH STRENGTH, DURABLE FABRICS PRODUCED BY FIBRILLATING MULTILOBAL FIBERS

(75) Inventors: Behnam Pourdeyhimi, Cary, NC (US); Stephen Sharp, Raleigh, NC (US)

(73) Assignee: North Carolina State University, Raleigh, NC (US)

( * ) Notice: Subject to any disclaimer, the term of this patent is extended or adjusted under 35 U.S.C. 154(b) by 388 days.

(21) Appl. No.: 11/769,871

(22) Filed: Jun. 28, 2007

(65) Prior Publication Data

US 2008/0003912 A1 Jan. 3, 2008

Related U.S. Application Data

(63) Continuation-in-part of application No. 11/473,534, filed on Jun. 23, 2006.

(60) Provisional application No. 60/694,121, filed on Jun. 24, 2005.

(51) Int. Cl.
*D02G 3/36* (2006.01)

(52) U.S. Cl. ..... 428/373; 428/364; 428/401

(58) Field of Classification Search ..... 442/364, 442/373, 375, 392, 394, 395, 397, 398, 401, 442/403; 428/364, 373, 401
See application file for complete search history.

(56) References Cited

U.S. PATENT DOCUMENTS 3,418,200 A 12/1968 Tanner
3,562,374 A 2/1971 Okamoto et al.
3,629,047 A 12/1971 Davison
3,724,198 A 4/1973 Kim
3,751,777 A 8/1973 Turmel et al.
3,829,324 A 8/1974 Blais et al.
3,855,046 A 12/1974 Hansen et al.
3,914,365 A 10/1975 Kim et al.
4,102,969 A 7/1978 Neveu et al.
4,127,696 A 11/1978 Okamoto
4,207,376 A 6/1980 Nagayasu et al.
4,274,251 A 6/1981 Kim et al.
4,381,335 A 4/1983 Okamoto
4,519,804 A * 5/1985 Kato et al. ..... 8/485
4,551,378 A 11/1985 Carey, Jr.
4,612,228 A 9/1986 Kato et al.
4,620,852 A 11/1986 Nishikawa et al.
4,866,107 A 9/1989 Doxsee et al.
5,009,239 A 4/1991 Cohen et al.
5,045,387 A 9/1991 Schmalz (Continued)

FOREIGN PATENT DOCUMENTS

EP 0 696 629 A1 2/1996

(Continued)

*Primary Examiner*—Andrew T Piziali
(74) *Attorney, Agent, or Firm*—Womble Carlyle Sandridge & Rice, PLLC

(57) ABSTRACT

A fabric including microdenier fibers is provided, the microdenier fibers prepared by fibrillating a multicomponent, multilobal fiber including a contiguous core fiber component enwrapped by a multilobal sheath fiber component such that the sheath fiber component forms the entire outer surface of the multicomponent fiber, wherein the core fiber component and the multilobal sheath fiber component are sized such that the multicomponent, multilobal fiber can be fibrillated to expose the core fiber component and split the fiber into multiple microdenier fibers.

20 Claims, 9 Drawing Sheets

U.S. PATENT DOCUMENTS

| | | | |
|---|---|---|---|
| 5,141,522 | A | 8/1992 | Landi |
| 5,334,177 | A | 8/1994 | Cohen |
| 5,336,552 | A | 8/1994 | Strack et al. |
| 5,403,426 | A | 4/1995 | Johnson et al. |
| 5,470,640 | A | 11/1995 | Modrak |
| 5,472,995 | A | 12/1995 | Kaminski et al. |
| 5,582,904 | A | 12/1996 | Harrington |
| RE35,621 | E | 10/1997 | Schmalz |
| 5,721,048 | A | 2/1998 | Schmalz |
| 5,783,503 | A | 7/1998 | Gillespie et al. |
| 5,786,065 | A | 7/1998 | Annis et al. |
| 5,827,443 | A | 10/1998 | Kita et al. |
| 5,869,010 | A | 2/1999 | Langer |
| 5,889,080 | A | 3/1999 | Kaminski et al. |
| 5,916,678 | A | 6/1999 | Jackson et al. |
| 5,919,837 | A | 7/1999 | Kaminski et al. |
| 5,948,528 | A | 9/1999 | Helms, Jr. et al. |
| 5,972,497 | A | 10/1999 | Hirwe et al. |
| 6,110,991 | A | 8/2000 | Kaminski et al. |
| 6,335,092 | B1 | 1/2002 | Takeda et al. |
| 6,448,462 | B2 | 9/2002 | Groitzsch et al. |
| 6,455,156 | B1 | 9/2002 | Tanaka et al. |
| 6,461,729 | B1 * | 10/2002 | Dugan ..... 428/373 |
| 6,506,873 | B1 | 1/2003 | Ryan et al. |
| 6,632,313 | B2 | 10/2003 | Nickel et al. |
| 7,291,300 | B2 | 11/2007 | Chhabra et al. |
| 2002/0006502 | A1 | 1/2002 | Nagaoka et al. |
| 2003/0203695 | A1 | 10/2003 | Polanco et al. |
| 2004/0266300 | A1 | 12/2004 | Isele et al. |
| 2005/0032450 | A1 * | 2/2005 | Haggard et al. ..... 442/327 |
| 2005/0070866 | A1 | 3/2005 | Isele et al. |
| 2006/0014460 | A1 | 1/2006 | Isele et al. |
| 2006/0057922 | A1 | 3/2006 | Bond et al. |
| 2006/0084340 | A1 | 4/2006 | Bond et al. |
| 2006/0292355 | A1 | 12/2006 | Pourdeyhimi et al. |
| 2007/0227359 | A1 | 10/2007 | Choi |

FOREIGN PATENT DOCUMENTS

| | | |
|---|---|---|
| EP | 0 696 691 A1 | 2/1996 |
| GB | 1 311 085 | 3/1973 |
| GB | 1 323 296 | 7/1973 |
| JP | 5-106118 | 4/1993 |
| JP | 2005171408 | 6/2005 |
| WO | WO 2005/004769 A1 | 1/2005 |

* cited by examiner

HIGH STRENGTH, DURABLE FABRICS PRODUCED BY FIBRILLATING MULTILOBAL FIBERS

CROSS-REFERENCE TO RELATED APPLICATIONS

This application is a continuation-in-part of U.S. Appl. Ser. No. 11/473,534, filed Jun. 23, 2006, which claims priority to U.S. Provisional Patent Application Ser. No. 60/694,121, filed Jun. 24, 2005, both of which are incorporated by reference in their entirety.

FIELD OF THE INVENTION

The invention relates generally to the manufacture of microdenier fibers and nonwoven products manufactured from such fibers having high strength.

BACKGROUND OF THE INVENTION

Nonwoven spunbonded fabrics are used in many applications and account for the majority of products produced or used in North America. Almost all such applications require a lightweight disposable fabric. Therefore, most spunbonded fabrics are designed for single use and are designed to have adequate properties for the applications for which they are intended. Spunbonding refers to a process where the fibers (filaments) are extruded, cooled, and drawn and subsequently collected on a moving belt to form a fabric. The web thus collected is not bonded and the filaments must be bonded together thermally, mechanically, or chemically to form a fabric. Thermal bonding is by far the most efficient and economical means for forming a fabric. Hydroentangling is not as efficient, but leads to a much more flexible and normally stronger fabric when compared to thermally bonded fabrics.

Microdenier fibers are fibers which are smaller than 1 denier. Typically, microdenier fibers are produced utilizing a bicomponent fiber which is split. FIG. 1 illustrates the best know type of splittable fiber commonly referred to as "pie wedge" or "segmented pie." U.S. Pat. No. 5,783,503 illustrates a typical meltspun muticomponent thermoplastic continuous filament which is split absent mechanical treatment. In the configuration described, it is desired to provide a hollow core filament. The hollow core prevents the tips of the wedges of like components from contacting each other at the center of the filament and promotes separation of the filament components.

In these configurations, the components are segments typically made from nylon and polyester. It is common for such a fiber to have 16 segments. The conventional wisdom behind such a fiber has been to form a web of typically 2 to 3 denier per filament fibers by means of carding and/or airlay, and subsequently split and bond the fibers into a fabric in one step by subjecting the web to high pressure water jets. The resultant fabric will be composed of microdenier fibers and will possess all of the characteristics of a microdenier fabric with respect to softness, drape, cover, and surface area.

When manufacturing bicomponent fibers for splitting, several characteristics of the fibers are typically required for consideration to ensure that the continuous fiber may be adequately manufactured. These characteristics include the miscibility of the components, differences in melting points, the crystallization properties, viscosity, and the ability to develop a triboelectric charge. The copolymers selected are typically done to ensure that these characteristics between the bicomponent fibers are accommodating such that the muticomponent filaments may be spun. Suitable combinations of polymers include polyester and polypropylene, polyester and polyethylene, nylon and polypropylene, nylon and polyethylene, and nylon and polyester. Since these bicomponent fibers are spun in a segmented cross-section, each component is exposed along the length of the fiber. Consequently, if the components selected do not have properties which are closely analogous, the continuous fiber may suffer defects during manufacturing such as breaking or crimping. Such defects would render the filament unsuitable for further processing.

U.S. Pat. No. 6,448,462 discloses another muticomponent filament having an orange-like multisegment structure representative of a pie configuration. This patent also discloses a side-by-side configuration. In these configurations, two incompatible polymers such as polyesters and a polyethylene or polyamide are utilized for forming a continuous muticomponent filament. These filaments are melt-spun, stretched and directly laid down to form a nonwoven. The use of this technology in a spunbond process coupled with hydro-splitting is now commercially available as a product marketed under the EVOLON® trademark by Freudenberg and is used in many of the same applications described above.

The segmented pie is only one of many possible splittable configurations. In the solid form, it is easier to spin, but in the hollow form, it is easier to split. To ensure splitting, dissimilar polymers are utilized. But even after choosing polymers with low mutual affinity, the fiber's cross section can have an impact on how easily the fiber will split. The cross section that is most readily splittable is a segmented ribbon, such as that shown in FIG. 2. The number of segments has to be odd so that the same polymer is found at both ends so as to "balance" the structure. This fiber is anisotropic and is difficult to process as a staple fiber. As a filament, however, it would work fine. Therefore, in the spunbonding process, this fiber can be attractive. Processing is improved in fibers such as tipped trilobal or segmented cross. See FIG. 3.

Another disadvantage utilizing segmented pie configurations is that the overall fiber shape upon splitting is a wedge shape. This configuration is a direct result of the process to producing the small microdenier fibers. Consequently, while suitable for their intended purpose, nonetheless, other shapes of fibers may be desired which produce advantageous application results. Such shapes are currently unavailable under standard segmented processes.

Accordingly, when manufacturing microdenier fibers utilizing the segmented pie format, certain limitations are placed upon the selection of the materials utilized and available. While the components must be of sufficiently different material so the adhesion between the components is minimized facilitating separation, they nonetheless also must be sufficiently similar in characteristics in order to enable the fiber to be manufactured during a spunbond or meltblown process. If the materials are sufficiently dissimilar, the fibers will break during processing.

Another method of creating microdenier fibers utilizes fibers of the island in the sea configuration. U.S. Pat. No. 6,455,156 discloses one such structure. In an island in the sea configuration, a primary fiber component, the sea, is utilized to envelope smaller interior fibers, the islands. Such structures provide for ease of manufacturing, but require the removal of the sea in order to reach the islands. This is done by dissolving the sea in a solution which does not impact the islands. Such a process is not environmentally friendly as an alkali solution is utilized, which requires waste water treatment. Additionally, since it is necessary to extract the island components, the method restricts the types of polymers which may be utilized in that they are not affected by the sea removal solution.

Such island in the sea fibers are commercially available today. They are most often used in making synthetic leathers and suedes. In the case of synthetic leathers, a subsequent step introduces coagulated polyurethane into the fabric, and may also include a top coating. Another end-use that has resulted in much interest in such fibers is in technical wipes, where the small fibers lead to a large number of small capillaries resulting in better fluid absorbency and better dust pick-up. For a similar reason, such fibers may be of interest in filtration.

In summary, what has been accomplished so far has limited application because of the limitations posed by the choice of the polymers that would allow ease of spinning and splittability for segmented fibers. The spinning is problematic because both polymers are exposed on the surface and therefore, variations in elongational viscosity, quench behavior, and relaxation cause anisotropies that lead to spinning challenges. Further, a major limitation of the current art is that the fibers form wedges and there is no flexibility with respect to fiber cross sections that can be achieved.

An advantage with an island in the sea technology is that if the spinpack is properly designed, the sea can act as a shield and protect the islands so as to reduce spinning challenges. However, with the requirement of removing the sea, limitations upon the availability of suitable polymers for the sea and island components are also restricted. Heretofore, islands in the sea technology is not employed for making microdenier fibers other than via the removal of the sea component because of the common belief that the energy required to separate the islands from the sea is not commercially viable.

Accordingly, there is a need for a manufacturing process which can produce microdenier fibers dimensions in a manner which is conducive to spunbound processing and which is environmentally sound.

SUMMARY OF THE INVENTION

The present invention provides multicomponent, multilobal fibers capable of fibrillating to form fiber webs comprising multiple microdenier fibers. The fibers of the invention can be used to form fabrics that exhibit a high degree of strength and durability due to the splitting and intertwining of the lobes of the fibers during processing. In particular, one embodiment of the invention provides a fabric comprising microdenier fibers, the microdenier fibers prepared by fibrillating a multicomponent, multilobal fiber comprising a contiguous core fiber component enwrapped by a multilobal sheath fiber component such that the sheath fiber component forms the entire outer surface of the multicomponent fiber, wherein the core fiber component and the multilobal sheath fiber component are sized such that the multicomponent, multilobal fiber can be fibrillated to expose the core fiber component and split the fiber into multiple microdenier fibers.

Exemplary multilobal sheath fiber components have 3 to about 8 lobes. Trilobal sheath components are particularly preferred. The volume of the core fiber component is typically about 20 to about 80 percent of the multicomponent, multilobal fiber, with the remainder being the sheath fiber component.

Although the polymers used in each portion of the fiber can vary, the core fiber component and the multilobal sheath fiber component each preferably comprise a different thermoplastic polymer selected from the following group: polyesters, polyamides, copolyetherester elastomers, polyolefins, polyacrylates, polyurethanes, cellulose esters, liquid crystalline polymers, and mixtures thereof. In one embodiment, at least one of the core fiber component and the multilobal sheath fiber component comprises a polymer selected from the group consisting of nylon 6, nylon 6/6, nylon 6,6/6, nylon 6/10, nylon 6/11, nylon 6/12, and mixtures thereof. In a particularly preferred embodiment, the core fiber component comprises a polyamide or polyester polymer and the multilobal sheath fiber component comprises a polyolefin, polyamide, polyester, or co-polyester, wherein the core fiber component polymer and the multilobal sheath fiber component polymer are different.

The core fiber component is advantageously a bicomponent fiber component comprising an outer component encapsulating an inner component. The inner component of the core fiber component optionally comprises one or more void spaces. Typically, both the inner component and the outer component of the core fiber component have a cross-sectional shape independently selected from the following group: circular, rectangular, square, oval, triangular, and multilobal. In one embodiment, both the inner component and the outer component of the core fiber component have a round or triangular cross-section, and the inner component optionally comprises one or more void spaces. The inner component of the core fiber component optionally has a multilobal cross-sectional shape. It is preferred for the inner component of the core fiber component to comprise the same polymer as the multilobal sheath fiber component. Typically, the outer component of the core fiber component comprises less than about 25% by volume of the multicomponent, multilobal fiber, preferably less than about 20% by volume of the multicomponent, multilobal fiber, and even more preferably less than about 15% by volume of the multicomponent, multilobal fiber.

In any of the above embodiments, the core fiber component, or a portion thereof such as the outer component, can be soluble in a solvent such as water or a caustic solution.

The fabric of the invention can be woven, knitted, or nonwoven, but hydroentangled nonwoven fabrics are particularly preferred. In one preferred embodiment, a hydroentangled, nonwoven fabric comprising microdenier fibers is provided, the microdenier fibers prepared by fibrillating a multicomponent, trilobal fiber comprising a contiguous core fiber component enwrapped by a multilobal sheath fiber component such that the sheath fiber component forms the entire outer surface of the multicomponent fiber, wherein the core fiber component and the multilobal sheath fiber component are sized such that the multicomponent, multilobal fiber can be fibrillated to expose the core fiber component and split the fiber into multiple microdenier fibers, and wherein the fibrillating step comprises hydroentangling the multicomponent, trilobal fibers.

In another aspect of the invention, a multicomponent, multilobal fiber is provided, the fiber comprising a contiguous core fiber component enwrapped by a multilobal sheath fiber component such that the sheath fiber component forms the entire outer surface of the multicomponent fiber, wherein the core fiber component and the multilobal sheath fiber component are sized such that the multicomponent, multilobal fiber can be fibrillated to expose the core fiber component and split the fiber into multiple microdenier fibers, and wherein the core fiber component is a bicomponent fiber component comprising an outer component encapsulating an inner component. As noted above, the inner component of the core fiber component may comprise a void space and both the inner component and the outer component of the core fiber component may have various cross-sectional shapes.

In a still further aspect of the invention, a method of preparing a nonwoven fabric comprising microdenier fibers is provided. The method comprises meltspinning a plurality of multicomponent, multilobal fibers comprising a contiguous core fiber component enwrapped by a multilobal sheath fiber component such that the sheath fiber component forms the entire outer surface of the multicomponent fiber, wherein the core fiber component and the multilobal sheath fiber component are sized such that the multicomponent, multilobal fibers can be fibrillated to expose the core fiber component and split the fibers into multiple microdenier fibers; forming a spunbonded web comprising the multicomponent, multilobal fibers; and fibrillating the multicomponent, multilobal fibers to expose the core fiber component and split the fibers into multiple microdenier fibers to form a nonwoven fabric comprising microdenier fibers. The fibrillating step can comprise hydroentangling the multicomponent, multilobal fibers, such as by exposing the spunbonded web to water pressure from one or more hydroentangling manifolds at a water pressure in the range of 10 bar to 1000 bar. The nonwoven fabric can also be thermally bonded if desired prior to or after the fibrillating step, and optionally the fabric can be needle punched prior to fibrillation.

BRIEF DESCRIPTION OF THE DRAWINGS

The methods and systems designed to carry out the invention will hereinafter be described, together with other features thereof. The invention will be more readily understood from a reading of the following specification and by reference to the accompanying drawings forming a part thereof.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. As used in the specification, and in the appended claims, the singular forms "a", "an", "the", include plural referents unless the context clearly dictates otherwise.

The present invention provides multicomponent, multilobal fibers that can be fibrillated to produce a plurality of microdenier fibers. As used herein, "microdenier" refers to a fiber having a denier of about 1 micron or less. As used herein, "multilobal" refers to fibers having a sheath component comprising 3 or more lobes that can be split from the core fiber component, and typically comprising 3 to about 8 lobes. The fibers of the invention can be used to form fabrics exhibiting high strength and durability, due in part to the fact that the multilobal fibers of the invention comprise a sheath fiber component that completely enwraps or encapsulates the core fiber component and forms the entire exterior surface of the fiber. By enwrapping the core completely during manufacture, the core fiber component is allowed to solidify and crystallize before the sheath (tip) fiber component. The core fiber component can be concentric or eccentric in location within the multicomponent fiber of the invention.

Figure 7A:
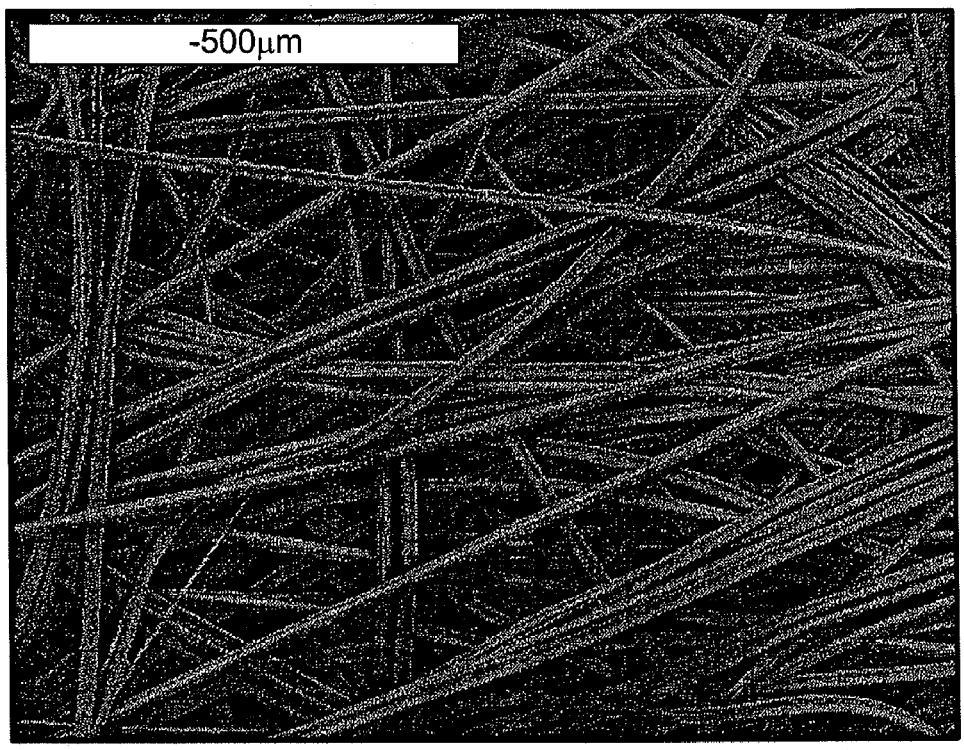
FIG. 7A is a SEM micrograph illustrating a modified tipped trilobal or trilobal sheath-core structure of the invention (100 gsm polyester/polyethylene fibers) that has been thermally bonded.
Figure 7B:
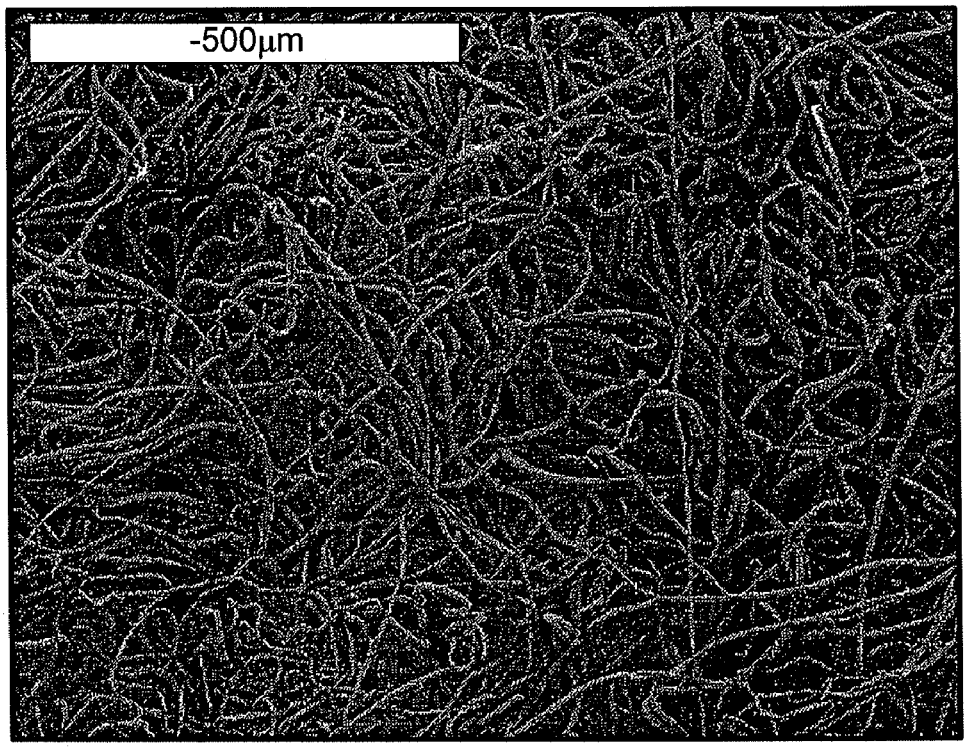
FIG. 7B is a SEM micrograph illustrating a modified tipped trilobal or trilobal sheath-core structure of the invention (100 gsm polyester/polyethylene fibers) that has been hydroentangled and fractured.
Figure 8A:
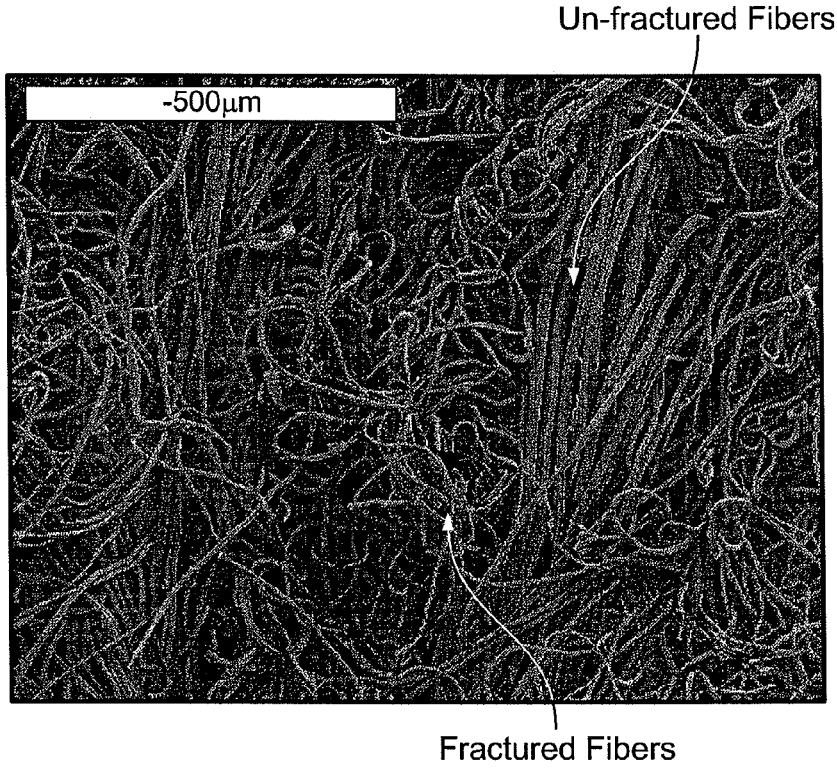
FIGS. 8A and 8B are SEM micrographs illustrating a modified tipped trilobal or trilobal sheath-core structure of the invention (75 gsm nylon/polyethylene fibers) that has been partially fibrillated such that whole trilobal fibers are still visible after two hydroentangling passes.
Figure 8B:
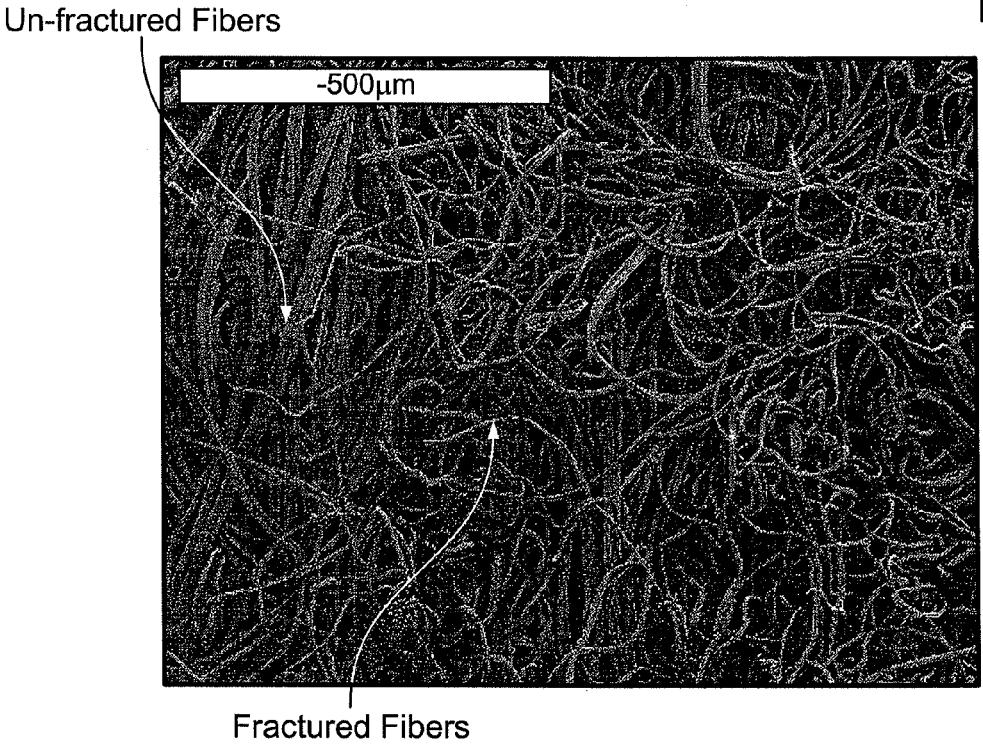

Fabrics formed using multicomponent fibers of the invention also exhibit high strength and durability because the fibers are configured to fibrillate into a plurality of fiber components when mechanical energy is introduced to the multicomponent fiber using, for example, techniques such as needle punching and/or hydroentangling. As used herein, "fibrillate" refers to a process of breaking apart a multicomponent fiber into a plurality of smaller fiber components. The multicomponent, multilobal fibers of the invention will fibrillate or split into separate fiber components consisting of each lobe of the multicomponent fiber and the core. Thus, splitting or fibrillating the fiber will expose the core fiber component and produce multiple microdenier fiber components. For example, fibrillating a trilobal embodiment of the multicomponent fiber of the invention will result in four separate fiber components: the core fiber component and three separate lobes. It is preferable for the method of splitting the fibers also cause entangling of the fibers such that the fibrillated fiber components enwrap one another, as shown in FIGS. 6-8. For example, the separated lobe fiber components can enwrap and entangle the core fiber component, which increases the strength, cohesiveness, and durability of the resulting fabric. Hydroentangling is a particularly preferred technique that can be used to simultaneously fibrillate and entangle the fibers of the invention.

In one embodiment, the invention provides a multicomponent, multilobal fiber comprising a contiguous core fiber component enwrapped by a multilobal sheath fiber component such that the sheath fiber component forms the entire outer surface of the multicomponent fiber. Such a fiber configuration is shown in FIGS. 6 and 9-12. It is preferred for the core fiber component and the multilobal sheath fiber component to be sized such that the multicomponent, multilobal fiber can be fibrillated to expose the core fiber component and split the fiber into multiple microdenier fiber. Typically, the core fiber component forms about 20 to about 80% by volume of the multicomponent fiber, and specific embodiments include 25% core fiber component/75% multilobal sheath fiber component, 50% core fiber component/50% multilobal sheath fiber component, and 75% core fiber component/25% sheath fiber component. It is preferable for the lobes of the multilobal sheath fiber component to be sized to produce microdenier fibers upon splitting. The core component can also be sized to produce a microdenier fiber upon splitting if desired. The modification ration of the multicomponent, multilobal fiber of the invention can vary, but is typically about 1.5 to about 4.

In selecting the materials for the fiber components, various types of melt-processable polymers can be utilized as long as the sheath fiber component is incompatible with the core fiber component. Incompatibility is defined herein as the two fiber components forming clear interfaces between the two such that one does no diffuse into the other. The use of incompatible polymers in the sheath and core enhances the ability to split the fiber into multiple, smaller fiber components. In particularly, use of hydroentangling as the means for fibrillating the multicomponent of the invention is easier where the bond between the sheath and core components is sufficiently weak and particularly when the two components have little or no affinity for one another. One of the better examples is utilization of nylon and polyester for the two components.

In one embodiment, the core fiber component and the multilobal sheath fiber component each comprise a different thermoplastic polymer selected from: polyesters, polyamides, copolyetherester elastomers, polyolefins, polyurethanes, polyacrylates, cellulose esters, liquid crystalline polymers, and mixtures thereof. A preferred copolyetherester elastomer has long chain ether ester units and short chain ester units joined head to tail through ester linkages. In one preferred embodiment, at least one of the core fiber component and the multilobal fiber sheath component comprises a polymer selected from the group consisting of nylon 6, nylon 6/6, nylon 6,6/6, nylon 6/10, nylon 6/11, nylon 6/12, and mixtures thereof. In yet another embodiment, the core fiber component comprises a polyamide or polyester polymer and the multilobal sheath fiber component comprises a polyolefin, polyamide, polyester, or co-polyester, wherein the core fiber component polymer and the multilobal sheath fiber component polymer are different. The sheath fiber component preferably has a lower viscosity than the core fiber component.

In certain embodiments, it may be desirable for the core fiber component, or a part thereof, to be soluble in a particular solvent so that the core fiber component can be removed from the fiber (or a fabric comprising the fiber) during processing. Any solvent extraction technique known in the art can be used to remove the soluble polymer component at any point following fiber formation. For example, the core fiber component could be formed from a polymer that is soluble in an aqueous caustic solution such as polyglycolic acid (PGA), polylactic acid (PLA), polycaprolactone (PCL), and copolymers or blends thereof. In another embodiment, the core fiber component could be formed form a polymer that is soluble in water such as sulfonated polyesters, polyvinyl alcohol, sulfonated polystyrene, and copolymers or polymer blends containing such polymers.

The polymeric components of the multicomponent fibers of the invention can optionally include other components or materials not adversely affecting the desired properties thereof. Exemplary materials that can be present include, without limitation, antioxidants, stabilizers, surfactants, waxes, flow promoters, solid solvents, particulates, and other materials added to enhance processability or end-use properties of the polymeric components. Such additives can be used in conventional amounts.

Figure 9A:
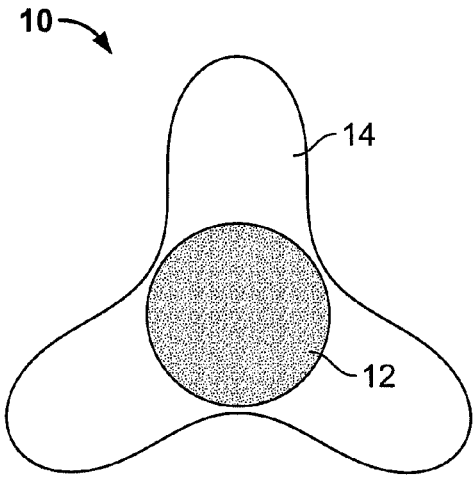
FIGS. 9A and 9B illustrate exemplary cross-sections of a trilobal fiber of the invention.
Figure 9B:
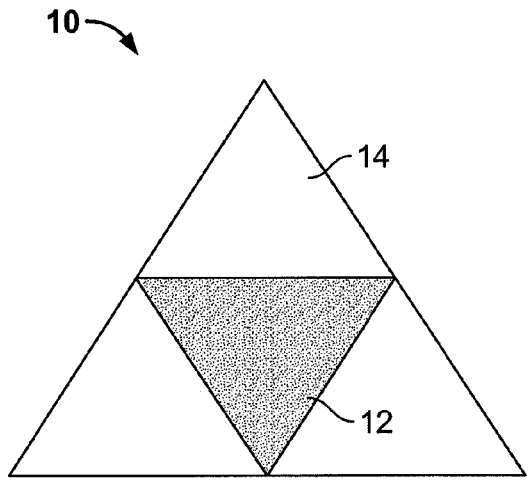
Figure 10A:
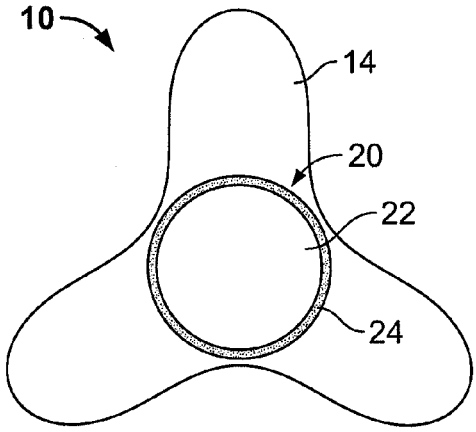
FIGS. 10A and 10B illustrate exemplary cross-sections of a trilobal fiber of the invention with a bicomponent core fiber component.
Figure 10B:
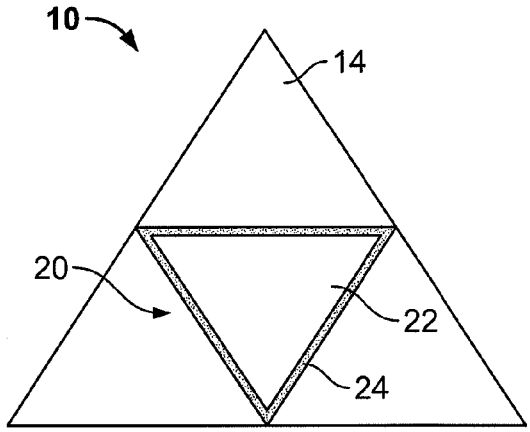

As shown in FIG. 9, the multicomponent fiber 10 of the invention can include a solid core fiber component 12 and a multilobal sheath fiber component 14 that encapsulates or enwraps the core fiber component. The cross-section of each fiber component can vary. For example, as shown in FIG. 9, the sheath fiber component 14 can comprise rounded lobes or triangular lobes. The core fiber component can comprise a circular cross-section or a triangular cross-section. Other potential cross-sectional shapes for the core fiber component include rectangular, square, oval, and multilobal.

For certain applications, it may be desirable to minimize the percentage of the core fiber component that comprises a polymer dissimilar from the polymer of the multilobal sheath component. Although the presence of some portion of a dissimilar polymer in the core fiber component is necessary to aid splitting of the multicomponent fiber, the amount can be minimized using fiber configurations illustrated in FIGS. 10-12. As shown in those figures, the core fiber component 20 comprises an inner component 22 and an outer component 24 encapsulating the inner component. In certain preferred embodiments, the inner component 22 is constructed of the same polymer material as the sheath fiber component 14. In this manner, the dissimilar polymer is confined to the outer component 24 of the core fiber component 20, which greatly reduces the overall amount of the dissimilar polymer in the multicomponent fiber 10. In certain embodiments, the outer component 24 can comprise no more than 20% by volume of the multicomponent fiber 10, typically no more than about 15% by volume, preferably no more than about 10% by volume, and more preferably no more than 5% by volume. In these embodiments, it may be desirable for the outer component 24 of the core fiber component 20 to be solvent-soluble as described above so that the outer component can be removed completely from the fiber, or fabric made therefrom, if desired.

Figure 11A:
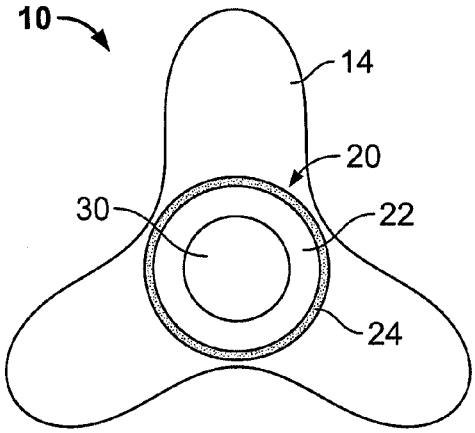
FIGS. 11A and 11B illustrate exemplary cross-sections of a trilobal fiber of the invention with a bicomponent core fiber component having a void space therein.
Figure 11B:
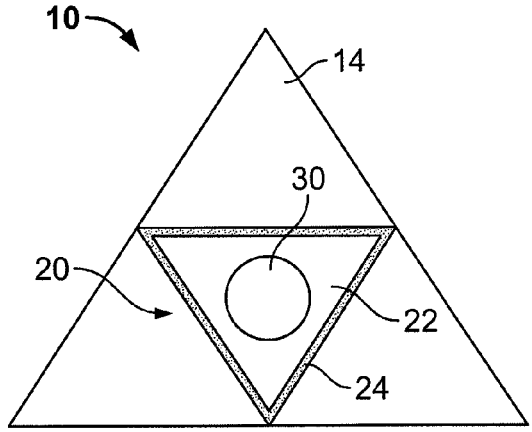

As shown in FIG. 11, the inner fiber component 22 may be hollow having a void space 30, which can reduce the overall cost of the multicomponent fiber by reducing the amount of polymer used and also advantageously alter the properties of the resulting fiber and any fabric made therefrom. Hollow fiber segments will provide additional bulk and resilience and will be preferred in applications requiring lower density.

Figure 12A:
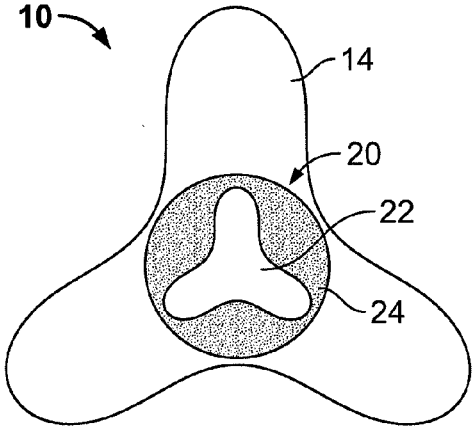
FIGS. 12A and 12B illustrate exemplary cross-sections of a trilobal fiber of the invention with a bicomponent core fiber component having an inner and outer component of different cross-sectional shape.
Figure 12B:
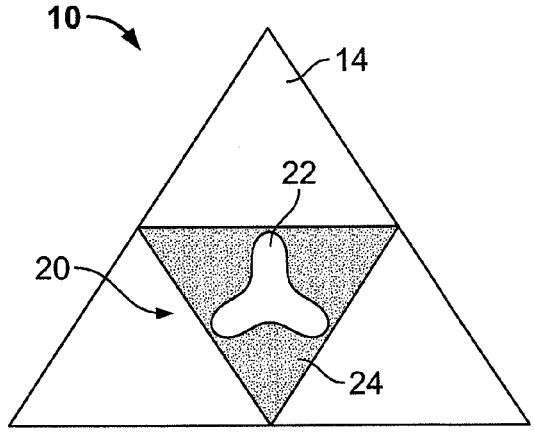

In another embodiment, the inner component 22 and outer component 24 of the core component 20 have different cross-sectional shapes. In particular, as illustrated in FIG. 12, the inner component 22 can have a multilobal cross-sectional shape and the outer component 24 can have a dissimilar cross-section, such as circular or triangular. The combination of different cross sections leads to higher transport because of the increased capillarity and will also influence printability and the hand of the fabric.

The multicomponent fibers of the invention can be used to form filament yarns and staple yarns. In these embodiments, splitting or fibrillation of the fibers can be accomplished by texturing, twisting, or washing the fiber with a solvent. Alternatively, fabrics can be made using the fibers of the invention, including woven, knitted, and nonwoven fabrics.

In one preferred embodiment, a fabric is provided that is a hydroentangled nonwoven fabric. As explained above, hydroentangling can be used to provide the mechanical energy necessary to fibrillate the fiber. The amount of mechanical energy necessary to fibrillate the fiber will depend on a number of factors, including the desired level of fibrillation (i.e., the percentage of fibers to be split), the polymers used in the core and sheath components of the fiber, the volume percentage of the core and sheath components of the fiber, and the fibrillating technique utilized. Where hydroentangling is used as the fibrillating energy source, the amount of energy typically necessary is between about 2000 Kj/Kg to about 6000 Kj/Kg. In one embodiment, the hydroentangling method involves exposing a web of the multicomponent fibers of the invention to water pressure from one or more hydroentangling manifolds at a water pressure in the range of 10 bar to 1000 bar.

Figure 1:
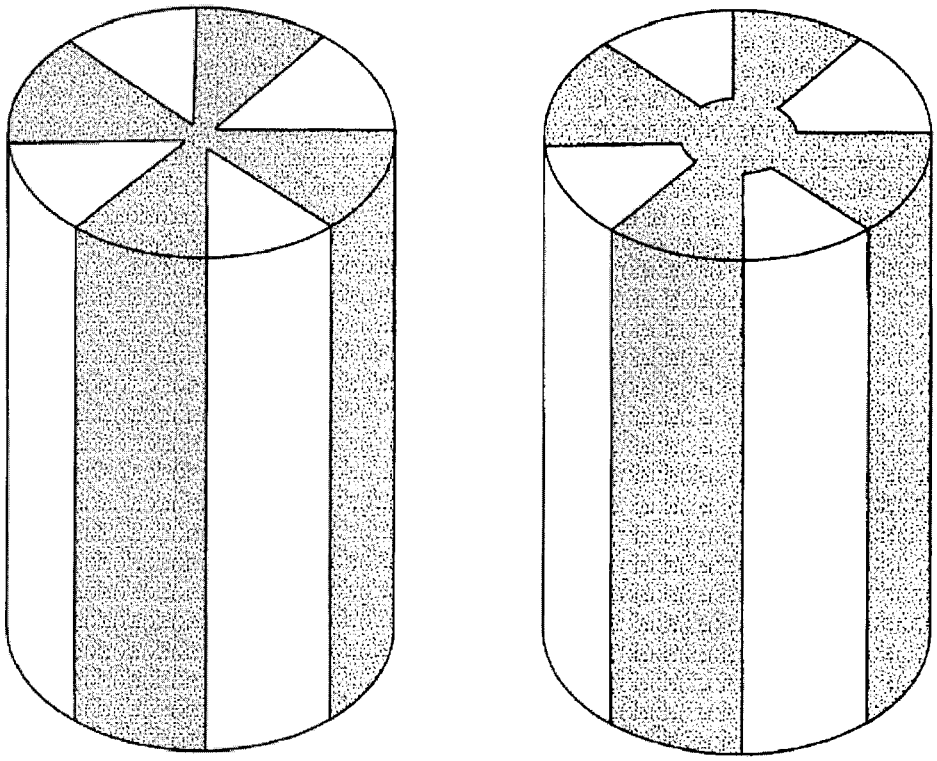
FIG. 1 (PRIOR ART)
FIG. 1 is schematic drawing of typical bicomponent segmented pie fiber, solid (left) and hollow (right)
Figure 2:
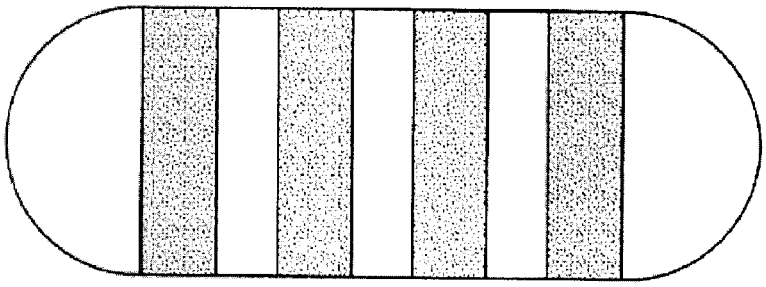
FIG. 2 (PRIOR ART)
FIG. 2 is schematic of a typical segmented ribbon fiber.
Figure 3A:
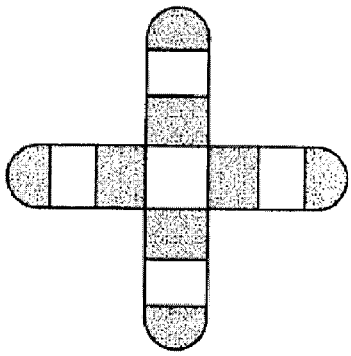
FIG. 3A (PRIOR ART)
FIG. 3A is schematic of a typical segmented cross fiber.
Figure 3B:
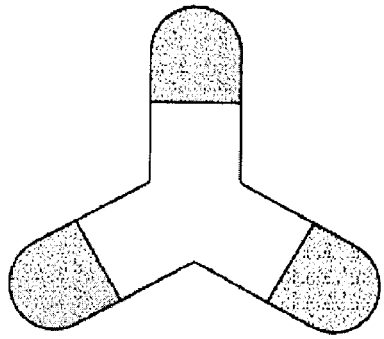
FIG. 3B (PRIOR ART)
FIG. 3B is schematic of a typical tipped trilobal fiber.
Figure 4:
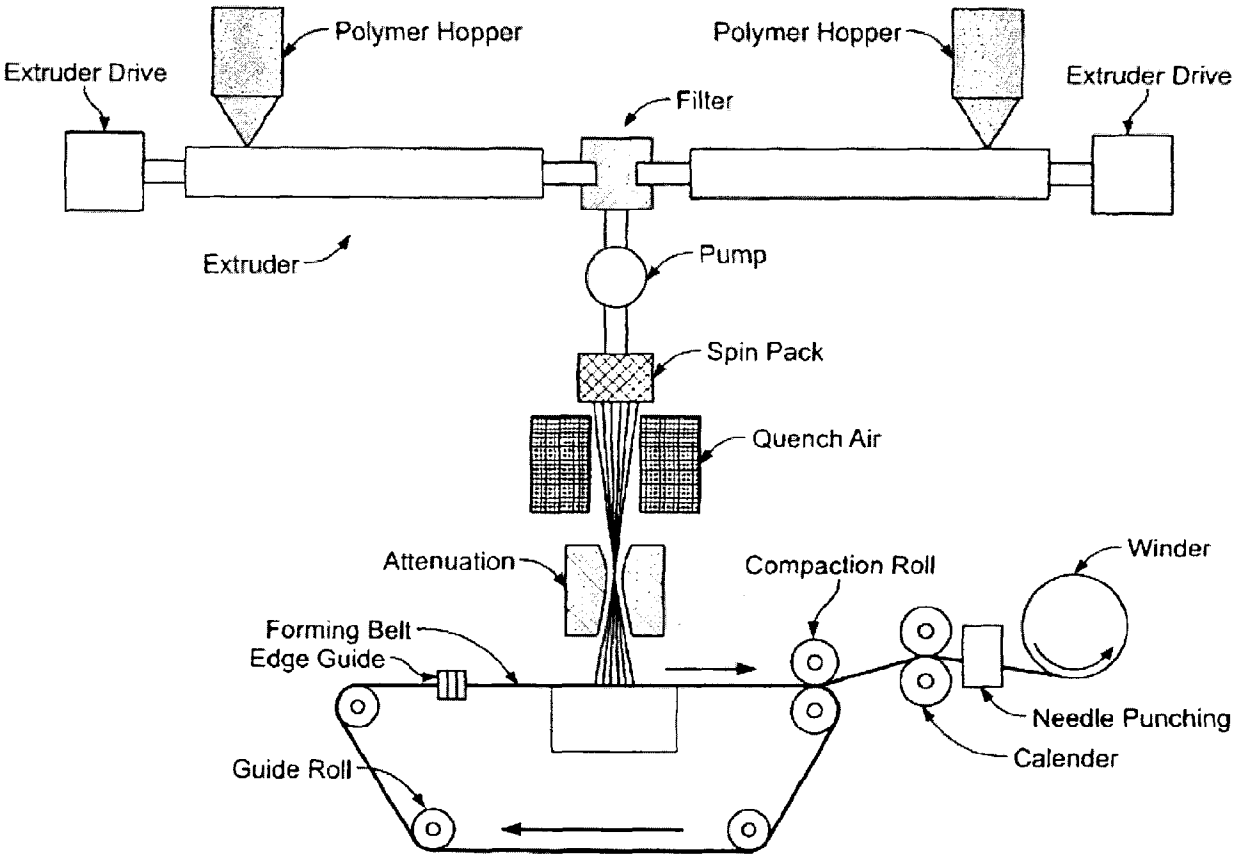
FIG. 4 (PRIOR ART)
FIG. 4 depicts a typical bicomponent spunbonding process.
Figure 5:
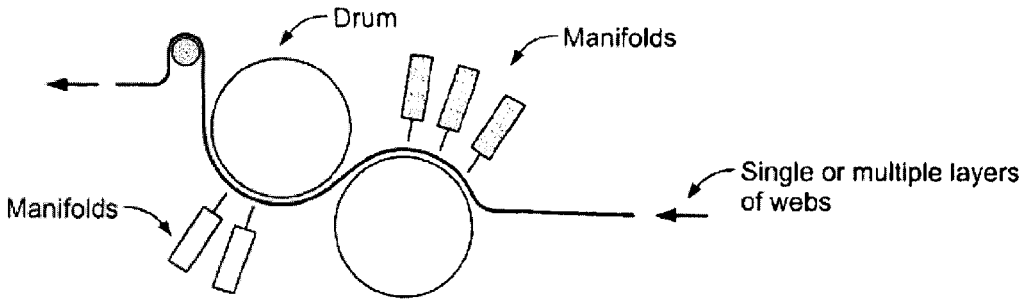
FIG. 5 (PRIOR ART)
FIG. 5 shows the typical process for hydroentangling using a drum entangler.
Figure 6A:
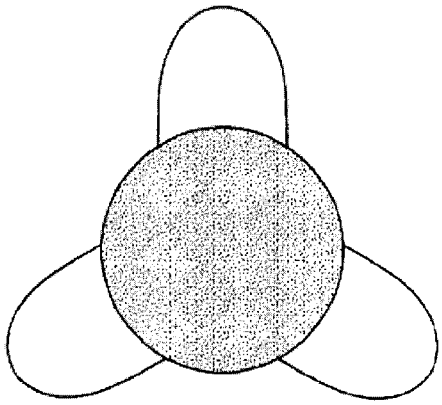
FIG. 6A illustrates a typical tipped trilobal fiber cross-section where both the core and the tips are exposed on the surface, which would create spinning difficulties for incompatible polymers.
Figure 6B:
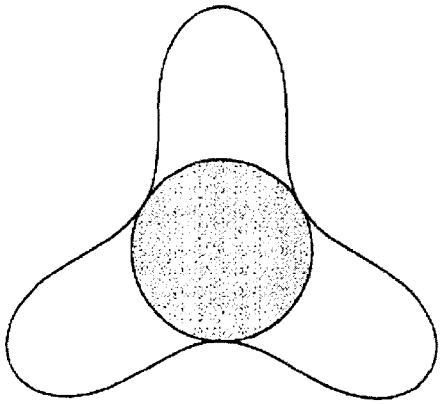
FIG. 6B illustrates a trilobal fiber cross-section of the invention that is modified so that the core is wrapped by the tips, thereby making spinning easier.
Figure 6C:
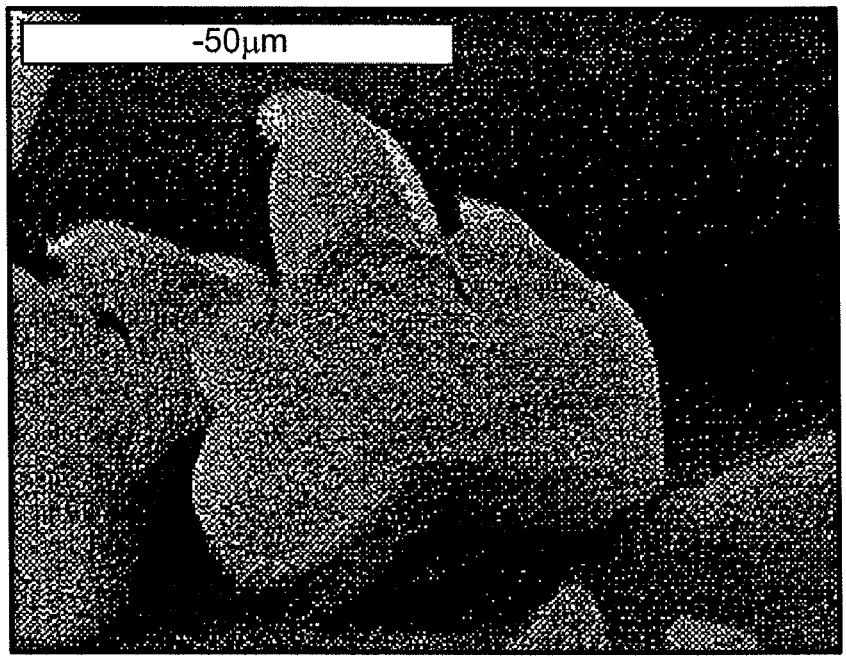
FIG. 6C is a SEM micrograph illustrating the cross-section of the trilobal fiber of the invention.
Figure 6D:
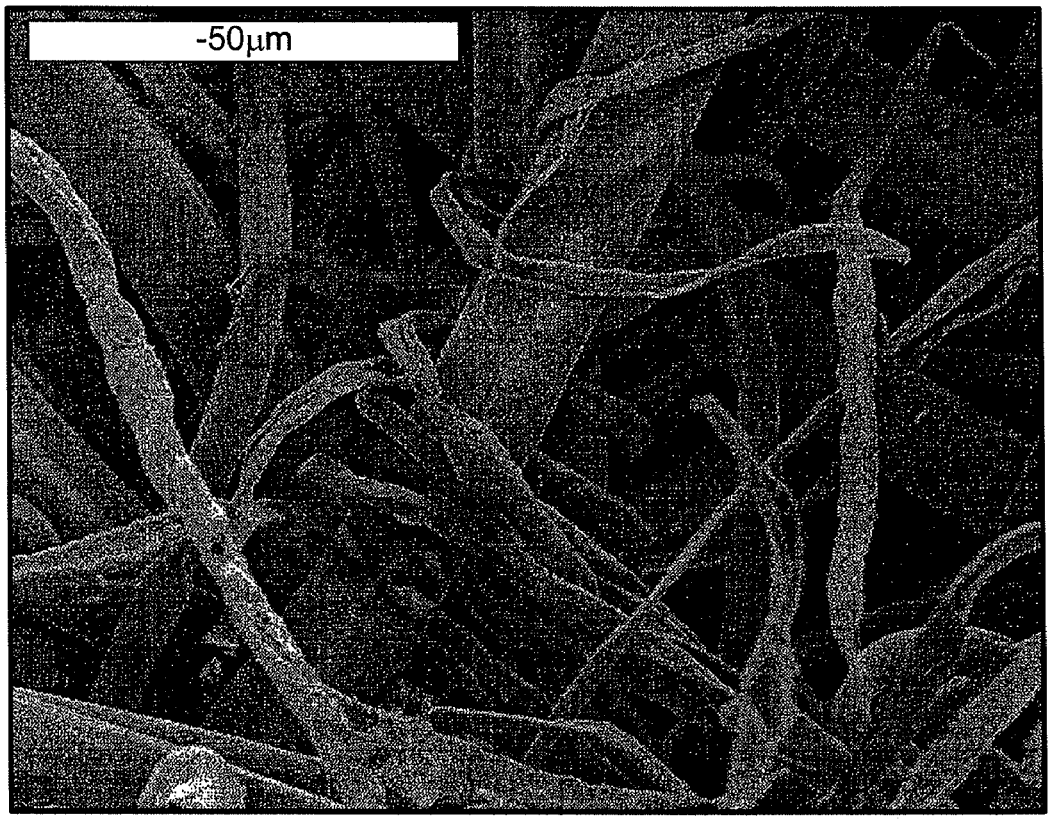
FIG. 6D is a SEM micrograph illustrating a fibrillated trilobal fiber of the invention where the core is wrapped by the fractured lobes or tips to produce four separate fibers, wherein fibrillation is accomplished by hydroentangling.

The invention also provides methods of preparing a fabric comprising the multicomponent fibers of the invention. In one preferred method, a nonwoven fabric comprising microdenier fibers is formed. An exemplary spunbonding process for forming nonwoven fabrics is illustrated in FIG. 4. As shown, at least two different polymer hoppers provide a melt-extrudable polymer that is filtered and pumped through a spin pack that combines the polymers in the desired cross-sectional multicomponent configuration. The molten fibers are then quenched with air, attenuated or drawn down, and deposited on a moving belt to form a fiber web. As shown, the process can optionally include thermal bonding the fiber web using heated calendaring rolls and/or a needle punching station. The fiber web can then be collected as shown in FIG. 4, although it is also possible to pass the fiber web through a hydroentangling process as shown in FIG. 5 prior to collection of the fiber web. As shown in FIG. 5, a typical hydroentangling process can include subjecting both sides of a fiber web to water pressure from multiple hydroentangling manifolds, although the process can also include impingement of water on only one side. The invention is not limited to spunbonding processes to produce a nonwoven fabric and also includes, for example, nonwoven fabrics formed using staple fibers formed into a web.

Thus, in one embodiment, the nonwoven fabric of the invention is provided by meltspinning a plurality of multicomponent, multilobal fibers comprising a contiguous core fiber component enwrapped by a multilobal sheath fiber component such that the sheath fiber component forms the entire outer surface of the multicomponent fiber, wherein the core fiber component and the multilobal sheath fiber component are sized such that the multicomponent, multilobal fibers can be fibrillated to expose the core fiber component and split the fibers into multiple microdenier fibers. The fibers are formed into a spunbonded web and fibrillated to expose the core fiber component and split the fibers into multiple microdenier fibers, thereby forming a nonwoven fabric comprising microdenier fibers.

During processing, the fibers are preferably drawn at a ratio of three or four to one and the fibers are spun vary rapidly, and in some examples at three and four thousand meters per minute or as high as six thousand meters per minute. With the core fiber component completely enwrapped, the core fiber solidifies more quickly than the sheath or tip fiber. Additionally, with the clear interface between the two components and low or no diffusion between the core and sheath fiber components, the multicomponent fibers of the invention are readily fibrillated.

The fibrillation step involves imparting mechanical energy to the multicomponent fibers of the invention using various means. For example, the fibrillation may be conducted mechanically, via heat, or via hydroentangling. Exemplary fibrillation techniques include:

(a) needle punching followed by hydroentangling without any thermal bonding wherein both the needle punching and the hydroentangling energy result in partial or complete splitting of the multilobal sheath and core;

(b) hydroentangling the web alone without any needle punching or subsequent thermal bonding wherein the hydroentangling energy result in partial or complete splitting of the multilobal sheath and core;

(c) hydroentangling the web as described in (a) above followed by thermal bonding in a calendar; or (d) hydroentangling the web as described in (a) above followed by thermal bonding in a thru-air oven at a temperature at or above the melting temperature of the sheath fiber component to form a stronger fabric.

The invention also provides articles manufactured utilizing the high strength, nonwoven fabrics of the invention, such as tents, parachutes, outdoor fabrics, house wrap, awning, and the like. Some examples have produced nonwoven articles having a tear strength greater than ten pounds. Furthermore, the nonwoven fabrics of the invention can exhibit a high degree of flexibility and breathability, and thus can be used to produce filters, wipes, cleaning cloths, and textiles which are durable and have good abrasion resistance. If more strength is required, the core and sheath fiber components may be subjected to thermal bonding after fibrillation, or chemical binders such as self cross-linking acrylics or polyurethanes may be added subsequently.

Another feature of the invention is that the fiber materials selected are receptive to coating with a resin to form an impermeable material or may be subjected to a jet dye process after the sheath component is fibrillated. Preferably, the fabric is stretched in the machine direction during a drying process for re-orientation of the fibers within the fabric and during the drying process, the temperature of the drying process is high enough above the glass transition of the polymers and below the onset of melting to create a memory by heat-setting so as to develop cross-wise stretch and recovery in the final fabric. Alternatively, the fabric may be stretched in the cross direction by employing a tenter frame to form machine-wise stretch and recovery.

Hydroentangled nonwoven fabrics prepared according to the invention exhibit commercially acceptable levels of strength (e.g., tongue tear strength, strip tensile strength, and grab tensile strength), moisture vapor permeability, and pilling resistance. For example, certain preferred embodiments of the invention provide moisture vapor permeability of at least about 18,000 g/sq. m·day, more preferably at least about 19,000 g/sq. m·day, and most preferably at least about 20,000 g/sq. m·day. In certain embodiments, the moisture vapor permeability is about 18,000 to about 31,000 g/sq. m·day. Exemplary embodiments of the invention exhibit tongue tear strength of at least about 5 lbs, more preferably at least about 6 lbs. In certain embodiments, the range of tongue tear strength is about 5 to about 7 lbs in both the machine and cross-machine directions. Exemplary embodiments of the invention exhibit a grab tensile strength of at least about 120 lbs, more preferably at least about 125 lbs, and most preferably at least about 130 lbs in the machine direction. A typical range for machine direction grab tensile strength is about 120 lbs to about 140 lbs. In the cross-machine direction, exemplary embodiments of the invention exhibit a grab tensile strength of at least about 60 lbs, more preferably at least about 65 lbs, and most preferably at least about 70 lbs. A typical cross-machine range for grab tensile strength is about 60 lbs to about 80 lbs. All of the above numbers are for a fabric having a basis weight of 135 gsm. Preferred embodiments of the invention are comparable or superior in many performance categories to the commercially available EVOLON® brand fabrics constructed of pie wedge fibers that are split into microfilaments. The performance data set forth herein was generated using tests performed according to ASTM standard test methods commonly used by the industry.

Experimental

Several examples are given below demonstrating the properties of the fabrics produced according to the invention.

EXAMPLE 1

Trilobal Fiber Comprising 75% Polyester Trilobal Sheath and 25% Nylon Core

Various hydroentangled nonwoven fabrics having a basis weight of about 135 gsm were formed, each having a 25% by volume nylon (available from BASF) core and a 75% polyester (PET available from Eastman) trilobal sheath. In certain embodiments, a binder was used. Grab tensile strength and tongue tensile strength was measured in both the machine direction (MD) and cross-machine direction (CD). The results are set forth in Tables 1 and 2 below. Table 3 provides moisture vapor transmission rate data for the fabrics.

TABLE 1

Grab Tensile [lb]

| Fabric Type | Binder Content | Hydroentangling Belt Pattern | Breaking Force MD (lbs) | Std Dev | Breaking Force CD (lbs) | Std Dev |
|---|---|---|---|---|---|---|
| Hydroentangled | no binder | Ribtek | 138 | 17 | 66 | 10 |
| Hydroentangled | 3% Acrylic | Ribtek | 128 | 10 | 68 | 6 |
| Hydroentangled | 3% Acrylic | 14 mesh | 128 | 10 | 54 | 10 |
| Hydroentangled | 10% PU | 14 mesh | 122 | 7 | 58 | 5 |
| Needle Punched and Hydroentangled | no binder | Ribtek | 77 | 4 | 39 | 7 |
| Needle Punched and Hydroentangled | 3% Acrylic | Ribtek | 79 | 8 | 41 | 6 |
| Hydroentangled | no binder | 100 mesh | 121 | 9 | 74 | 3 |
| Hydroentangled | 3% Acrylic | 100 mesh | 124 | 14 | 79 | 11 |

TABLE 2

Tongue Tear Strength [lbs]

| Fabric Type | Binder Content | Hydroentangling Belt Pattern | Tear Strength MD (lbs) | Std Dev | Tear Strength CD (lbs) | Std Dev |
|---|---|---|---|---|---|---|
| Hydroentangled | no binder | Ribtek | 6 | 1 | 7 | 1 |
| Hydroentangled | 3% Acrylic | Ribtek | 5 | 1 | 6 | 1 |
| Hydroentangled | 3% Acrylic | 14 mesh | 4 | 0 | 6 | 1 |
| Hydroentangled | 10% PU | 14 mesh | 5 | 1 | 6 | 2 |
| Needle Punched and Hydroentangled | no binder | Ribtek | 3 | 0 | 4 | 0 |
| Needle Punched and Hydroentangled | 3% Acrylic | Ribtek | 2 | 0 | 5 | 1 |
| Hydroentangled | no binder | 100 mesh | 5 | 0 | 6 | 0 |
| Hydroentangled | 3% Acrylic | 100 mesh | 6 | 1 | 7 | 1 |

TABLE 3

| Moisture Vapor Transmission Rate | | | | |
|---|---|---|---|---|
| Fabric Type | Binder | Pattern | MVTR (g/sq. m day) | Std Dev |
| Hydroentangled | no binder | Ribtek | 19435 | 2028 |
| Hydroentangled | 3% Acrylic | Ribtek | 18809 | 2386 |
| Needle Punched and Hydroentangled | no binder | Ribtek | 30676 | 3231 |
| Needle Punched and Hydroentangled | 3% Acrylic | Ribtek | 30461 | 6897 |
| Fabric Type | Binder | Pattern | MVTR (g/sq. m day) | Std Dev |
| Hydroentangled | no binder | 100 mesh | 25828 | 1631 |
| Hydroentangled | 3% Acrylic | 100 mesh | 25310 | 3178 |

EXAMPLE 2

Trilobal Fiber Comprising 75% Polyethylene Trilobal Sheath and 25% Nylon Core Hydroentangled nonwoven fabrics having a basis weight of either 50 gsm or 75 gsm were formed, each having a 25% by volume nylon (available from BASF) core and a 75% polyethylene (available from Dow) trilobal sheath. Grab tensile strength was measured in both the machine direction (MD) and cross-machine direction (CD). The results are set forth in Table 4 below.

TABLE 4

| Grab Tensile [lbs] | | | | | | |
|---|---|---|---|---|---|---|
| Fabric Weight (gsm) | Binder Content | Hydroentangling Belt Pattern | Breaking Force MD (lbs) | Std Dev | Breaking Force CD (lbs) | Std Dev |
| 50 | no binder | 100 mesh | 25 | 4 | 4 | 0 |
| 75 | no binder | 100 mesh | 40 | 4 | 7 | 1 |

EXAMPLE 3

Trilobal Fiber Comprising 50% Polyethylene Trilobal Sheath and 50% Nylon Core Hydroentangled nonwoven fabrics having a basis weight of either 50 gsm or 75 gsm were formed, each having a 50% by volume nylon (available from BASF) core and a 50% polyethylene (available from Dow) trilobal sheath. Grab tensile strength was measured in both the machine direction (MD) and cross-machine direction (CD). The results are set forth in Table 5 below.

TABLE 5

| Grab Tensile [lbs] | | | | | | |
|---|---|---|---|---|---|---|
| Fabric Weight (gsm) | Binder Content | Hydroentangling Belt Pattern | Breaking Force MD (lbs) | Std Dev | Breaking Force CD (lbs) | Std Dev |
| 50 | no binder | 100 mesh | 38 | 8 | 7 | 0 |
| 75 | no binder | 100 mesh | 53 | 5 | 12 | 1 |

EXAMPLE 4

Trilobal Fiber Comprising Polyester and Polyethylene

Hydroentangled nonwoven fabrics having a basis weight of about 125 gsm were formed, each having a PET core and a polyethylene trilobal sheath. Grab tensile strength was measured in both the machine direction (MD) and cross-machine direction (CD). The results are set forth in Table 6 below.

TABLE 6

| Grab Tensile [lbs] | | | | | | |
|---|---|---|---|---|---|---|
| PET/PE Ratio (%) | Binder Content | Hydroentangling Belt Pattern | Breaking Force MD (lbs) | Std Dev | Breaking Force CD (lbs) | Std Dev |
| 25/75 | no binder | 100 mesh | 74 | 9 | 23 | 4 |
| 50/50 | no binder | 100 mesh | 54 | 4 | 29 | 2 |
| 75/25 | no binder | 100 mesh | 49 | 1 | 28 | 4 |

That which is claimed:

1. A multicomponent, multilobal fiber comprising a single contiguous core fiber component enwrapped by a multilobal sheath fiber component such that the sheath fiber component forms the entire outer surface of the multicomponent fiber, wherein each lobe of the multilobal sheath fiber component is microdenier-sized, and wherein the core fiber component consists of a single contiguous bicomponent fiber comprising an outer component encapsulating an inner component.

2. The multicomponent, multilobal fiber of claim 1, wherein the inner component of the core fiber component comprises one or more void spaces.

3. The multicomponent, multilobal fiber of claim 1, wherein both the inner component and the outer component of the core fiber component have a cross-sectional shape independently selected from the group consisting of circular, rectangular, square, oval, triangular, and multilobal.

4. The multicomponent, multilobal fiber of claim 1, wherein both the inner component and the outer component of the core fiber component have a round or triangular cross-section, wherein the inner component optionally comprises one or more void spaces.

5. The multicomponent, multilobal fiber of claim 1, wherein the inner component of the core fiber component has a multilobal cross-sectional shape.

6. The multicomponent, multilobal fiber of claim 1, wherein the inner component of the core fiber component comprises the same polymer as the multilobal sheath fiber component and where the outer component of the core fiber component comprises a polymer dissimilar from the polymer of the sheath fiber component.

7. The multicomponent, multilobal fiber of claim 1, wherein the outer component of the core fiber component comprises less than 25% by volume of the multicomponent, multilobal fiber.

8. The multicomponent, multilobal fiber of claim 7, wherein the outer component of the core fiber component comprises less than 20% by volume of the multicomponent, multilobal fiber.

9. The multicomponent, multilobal fiber of claim 8, wherein the outer component of the core fiber component comprises less than 15% by volume of the multicomponent, multilobal fiber.

10. The multicomponent, multilobal fiber of claim 1, wherein the outer component of the core fiber component is soluble in water or caustic solution.

11. The multicomponent, multilobal fiber of claim 9, wherein the outer component of the core fiber component comprises less than 10% by volume of the multicomponent, multilobal fiber.

12. The multicomponent, multilobal fiber of claim 11, wherein the outer component of the core fiber component comprises less than 5% by volume of the multicomponent, multilobal fiber.

13. The multicomponent, multilobal fiber of claim 1, wherein the multilobal sheath fiber component comprises 3 or more lobes.

14. The multicomponent, multilobal fiber of claim 13, wherein the multilobal sheath fiber component comprises 3 to 8 lobes.

15. The multicomponent, multilobal fiber of claim 1, wherein the sheath fiber component comprises a polyolefin, polyamide, polyester, or copolyetherester elastomer.

16. The multicomponent, multilobal fiber of claim 1, wherein the volume of the core fiber component is 20 to 80 percent of the multicomponent, multilobal fiber.

17. The multicomponent, multilobal fiber of claim 1, wherein the core fiber component and the multilobal sheath fiber component each comprise a different thermoplastic polymer selected from the group consisting of polyesters, polyamides, copolyetherester elastomers, polyolefins, polyurethanes, polyacrylates, cellulose esters, liquid crystalline polymers, and mixtures thereof.

18. The multicomponent, multilobal fiber of claim 1, wherein at least one of the core fiber component and the multilobal fiber sheath component comprises a polymer selected from the group consisting of nylon 6, nylon 6/6, nylon 6,6/6, nylon 6/10, nylon 6/11, nylon 6/12, and mixtures thereof.

19. The multicomponent, multilobal fiber of claim 1, wherein the core fiber component comprises a polyamide or polyester polymer and the multilobal sheath fiber component comprises a polyolefin, polyamide, polyester, or co-polyester, wherein the core fiber component polymer and the multilobal sheath fiber component polymer are different.

20. The multicomponent, multilobal fiber of claim 6, wherein the multilobal sheath fiber component comprises a polyolefin, polyamide, polyester, or copolyetherester elastomer.

* * * * *

UNITED STATES PATENT AND TRADEMARK OFFICE
Certificate

Patent No. 7,883,772 B2 Patented: February 8, 2011

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Behnam Pourdeyhimi, Cary, NC (US).

Signed and Sealed this Fifteenth Day of October 2013.

MARIA VERONICA EWALD
*Supervisory Patent Examiner*
Art Unit 1783
Technology Center 1700